US007131917B2

(12) United States Patent
Spencer

(10) Patent No.: US 7,131,917 B2
(45) Date of Patent: Nov. 7, 2006

(54) FOOTBALL TRAINING APPARATUS

(76) Inventor: Jimmy Spencer, 11462 S. Marlborough Dr., Parker, CO (US) 80138

( * ) Notice: Subject to any disclaimer, the term of this patent is extended or adjusted under 35 U.S.C. 154(b) by 42 days.

(21) Appl. No.: 10/985,435

(22) Filed: Nov. 10, 2004

(65) Prior Publication Data

US 2006/0100040 A1 May 11, 2006

(51) Int. Cl.
*A63B 69/34* (2006.01)
*A63B 69/00* (2006.01)

(52) U.S. Cl. ..... 473/444; 473/441; 482/83; 482/84

(58) Field of Classification Search ..... 473/441, 473/422, 438, 442, 443–445, 447, 448; 434/451; 482/83–90

See application file for complete search history.

(56) References Cited

U.S. PATENT DOCUMENTS 2,909,370 A * 10/1959 Fortney ..... 482/83
3,250,533 A * 5/1966 Nicholson ..... 482/83
3,416,795 A * 12/1968 Lewis et al. ..... 473/444
3,680,861 A * 8/1972 Schmidt ..... 473/444
4,088,315 A * 5/1978 Schemmel ..... 482/4
4,401,303 A * 8/1983 Anderson et al. ..... 482/4
4,534,557 A * 8/1985 Bigelow et al. ..... 473/442
4,721,302 A * 1/1988 Murphy ..... 482/89
4,883,271 A * 11/1989 French ..... 273/454
4,941,660 A * 7/1990 Winn et al. ..... 482/8
5,110,124 A * 5/1992 Micco ..... 473/441
5,176,560 A * 1/1993 Wetherell et al. ..... 446/175
5,280,905 A * 1/1994 Micco ..... 473/444
5,281,191 A * 1/1994 DeSousa ..... 482/83
5,624,358 A * 4/1997 Hestilow ..... 482/90
5,716,302 A * 2/1998 Andersson ..... 482/84
6,110,079 A * 8/2000 Luedke et al. ..... 482/83
6,390,958 B1 * 5/2002 Chu ..... 482/90
6,464,621 B1 * 10/2002 Chen ..... 482/83
2004/0058787 A1 * 3/2004 Lin ..... 482/84

* cited by examiner

*Primary Examiner*—Mitra Aryanpour
(74) *Attorney, Agent, or Firm*—Mark D. Bowen, Esq.; Sterns Weaver Miller Weissler Alhadeff & Sitterson, PA

(57) ABSTRACT

A football blocking and tackling dummy adapted with an electrically actuated rotatable torso that provides resistance during blocking drills thereby improving the effectiveness of the drills is disclosed. The football blocking dummy includes a base, and a blocking dummy pivotally connected to the base. The blocking dummy has an upper torso portion rotatably connected to a lower body portion connected to the base. The upper torso portion includes left and right pressure pad sensors that function, upon application of a force, to actuate rotation of the upper torso in a direction opposing the applied force. As a result, the football blocking dummy provides resistance to a force applied thereto, thus simulating the forces and reactions experienced when one football player applies force to an opposing player.

6 Claims, 20 Drawing Sheets

FOOTBALL TRAINING APPARATUS

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates to blocking and tackling dummies used during football practice to teach football skills to athletes. More particularly, the present invention relates to an electronic practice dummy adapted with an electrically actuated rotatable torso for providing resistance primarily during blocking drills.

2. Description of Related Art

The use of blocking and tackling dummies to teach athletes proper football techniques and skills during practice sessions is well known. Conventional blocking and tackling dummies comprise relatively simple structures adapted with padded areas. Practice dummies are typically placed in front of an oncoming athlete to provide a target structure for practicing blocking and tackling techniques. Conventional blocking and tackling dummies are typically static structures, and may sometimes be manipulated during use by the coaching staff. As a result, football blocking and tackling dummies known in the art are limited.

Since certain football skills, particularly blocking skills, are best taught by applying active resistance during drills, there exists a need for improvements in the art. More particularly, there exists a need for an improved football blocking and tackling dummy capable of automatically generating resistance and movement in directions opposite of forces applied by an athlete while practicing certain blocking techniques.

BRIEF SUMMARY OF THE INVENTION

The present invention provides a blocking and tackling dummy adapted with an electrically actuated rotatable torso that provides resistance during blocking drills thereby improving the effectiveness of the drills. A football blocking dummy according to the present invention includes a base, and a blocking dummy pivotally connected to the base. The blocking dummy preferably includes an upper torso portion rotatably connected to a lower portion which is in turn pivotally connected to the base. The upper torso portion includes left and right pressure sensors that function, upon application of a force, to actuate rotation of the upper torso in a direction opposing the applied force. As a result, a football blocking dummy according to the present invention provides resistance to a force applied thereto, thus simulating the forces and reactions experienced when one football player applies force to an opposing player.

Accordingly, it is an object of the present invention to provide an improved blocking and tackling dummy for use in athletic training.

Another object of the present invention is to provide a football blocking dummy adapted for generating resistance to an applied force.

Still another object of the present invention is to provide a football blocking dummy having a rotatable torso adapted to generate resistance to a force applied thereto.

In accordance with these and other objects, which will become apparent hereinafter, the instant invention will now be described with particular reference to the accompanying drawings.

DETAILED DESCRIPTION OF THE INVENTION

Figure 15:
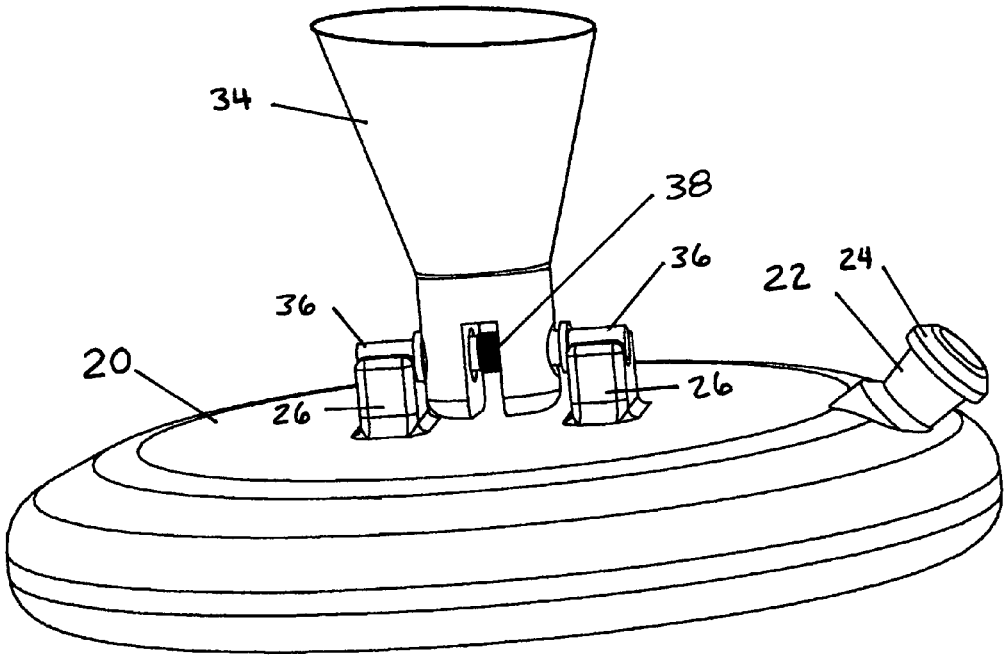
FIG. 15 is a detail view of the base portion thereof.
Figure 16:
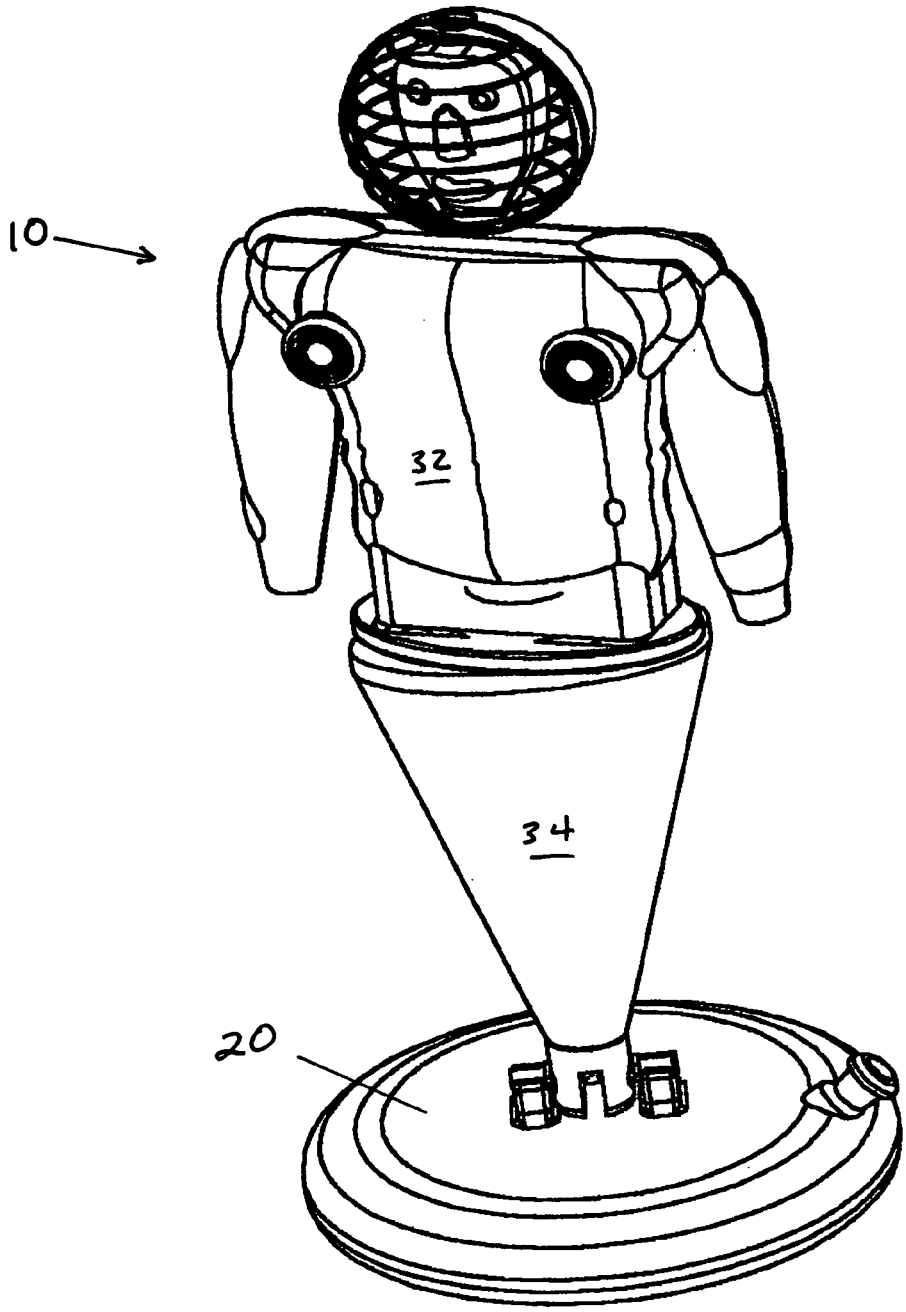
FIG. 16 is a front perspective view thereof depicting the torso rotated clockwise.
Figure 17:
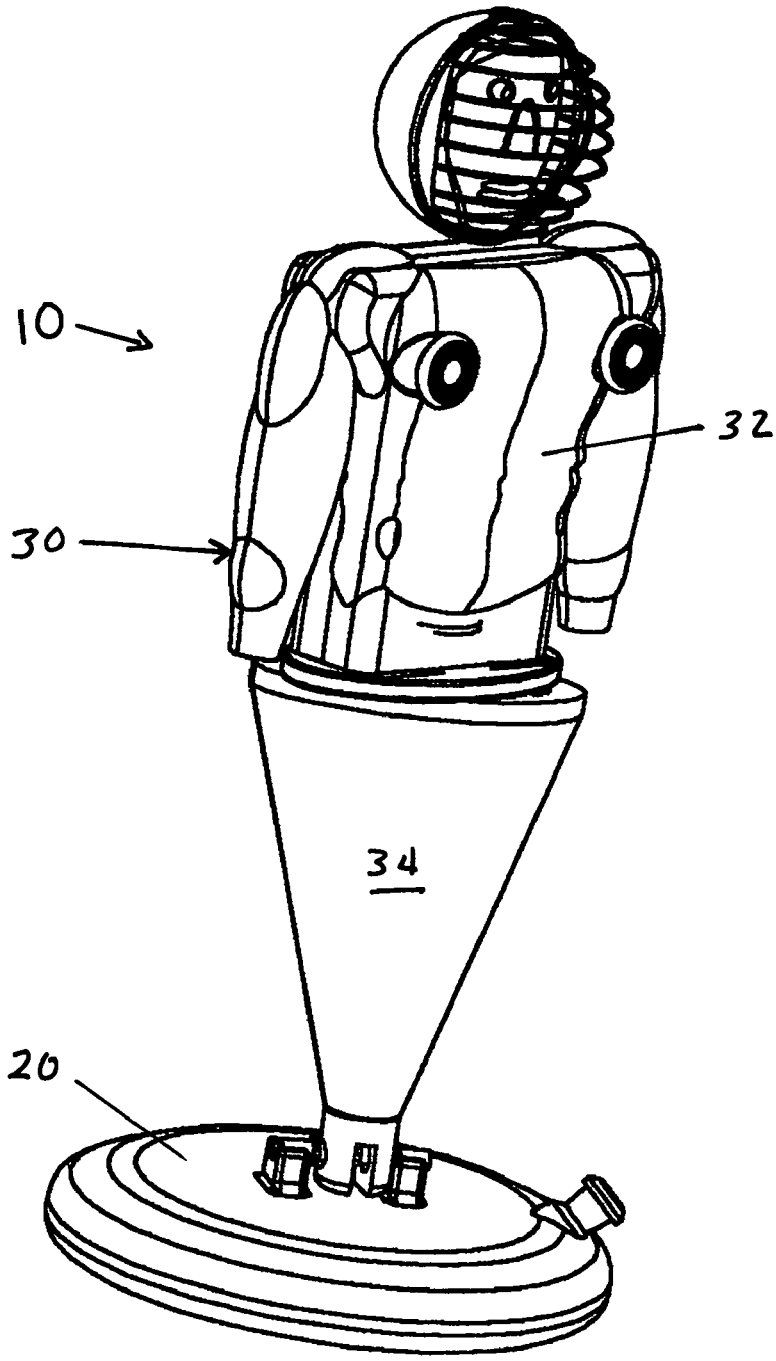
FIG. 17 is a front perspective view thereof depicting the torso rotated counter-clockwise.

With reference now to the drawings, FIGS. 1–20 depict a blocking and tackling dummy, generally referenced as 10, adapted with an electrically actuated rotatable torso that provides resistance during blocking drills thereby improving the effectiveness of the drills. According to a preferred embodiment, football blocking dummy 10 includes a base 20, and a blocking dummy body 30 pivotally connected to base 10. The blocking dummy body is preferably structured to resemble a football player, and may be fabricated with a generally soft, but impact resistant outer shell to simulate the human body. For example, body 30 may have an outer layer of foam material. Base 20 is preferably hollow and disk shaped as best illustrated in FIGS. 1–3 and 15. Base 20 includes an opening 22 communicating with the interior volume defined by base 20, and a removable closure 24, such as a removable cap, connected thereto. Opening 20 functions as a fill port for the addition and removal of ballast, such as sand, water, or any other suitable ballast material, to maintain blocking dummy 10 upright during use. Base 20 further includes a pair of upwardly projecting flanges, referenced as 26 for receiving opposing pivot pins 36 projecting from the bottom of lower body portion 34. As best depicted in FIG. 15, a helical coil spring 38 biases dummy body 30 to a forward leaning position and provides resistance to backward pivotal movement upon impact by a player.

Figure 1:
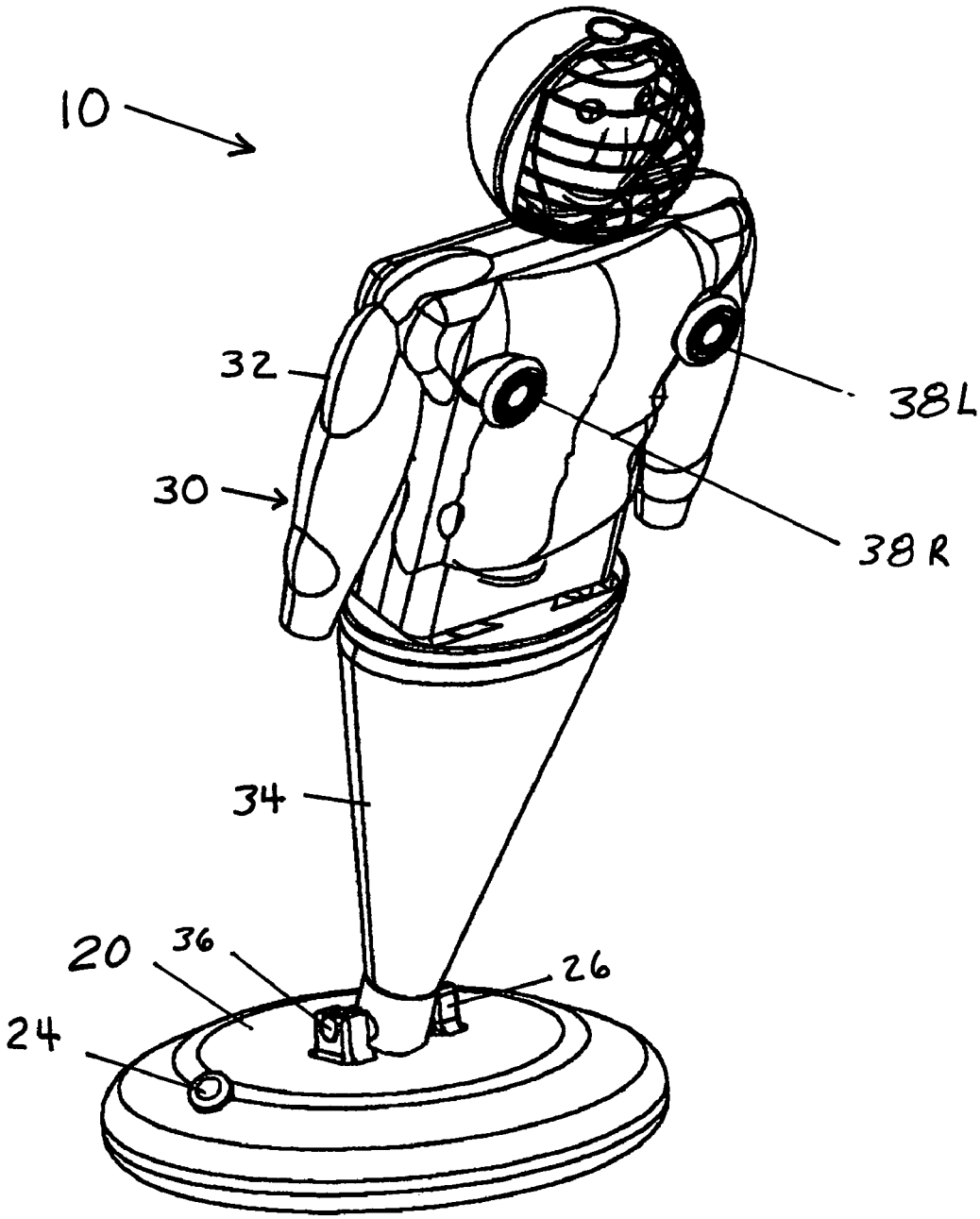
FIGS. 1 and 2 are front perspective views of a football training dummy according to the present invention.
Figure 2:
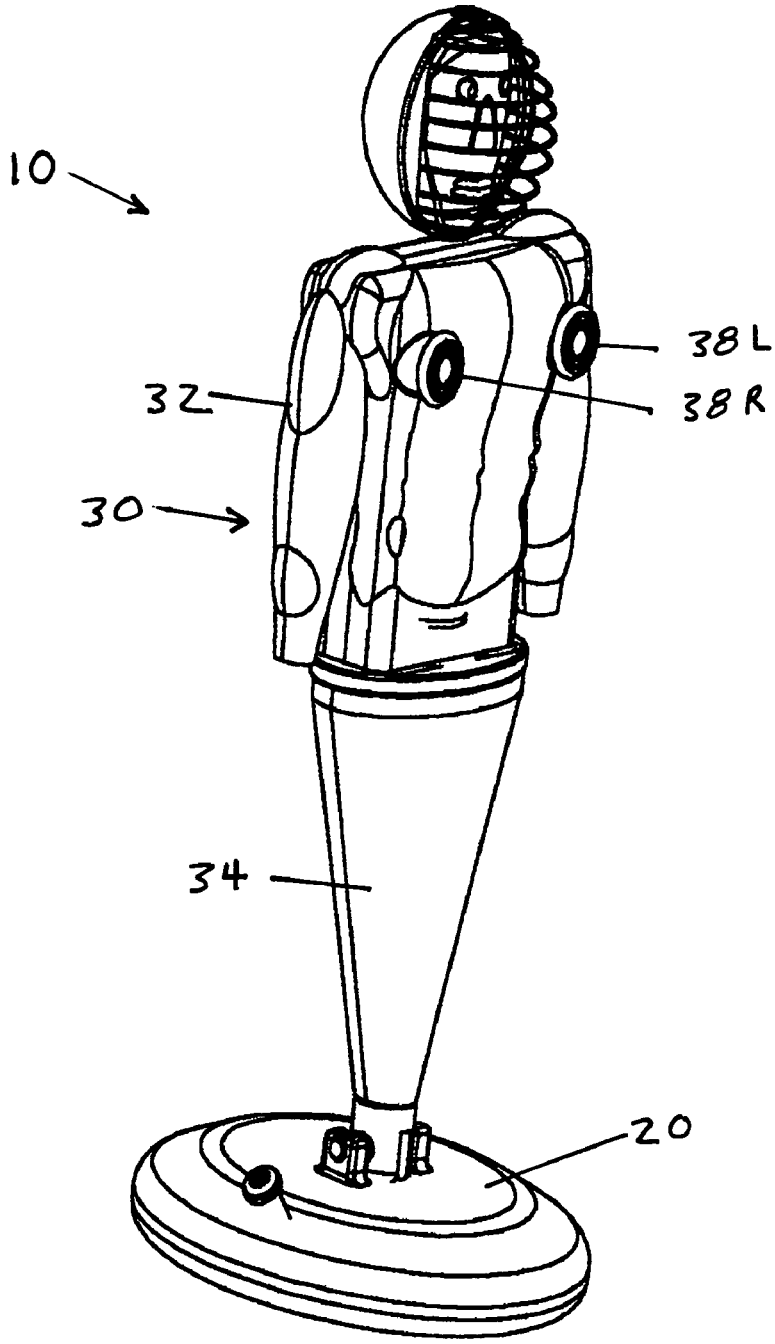
Figure 3:
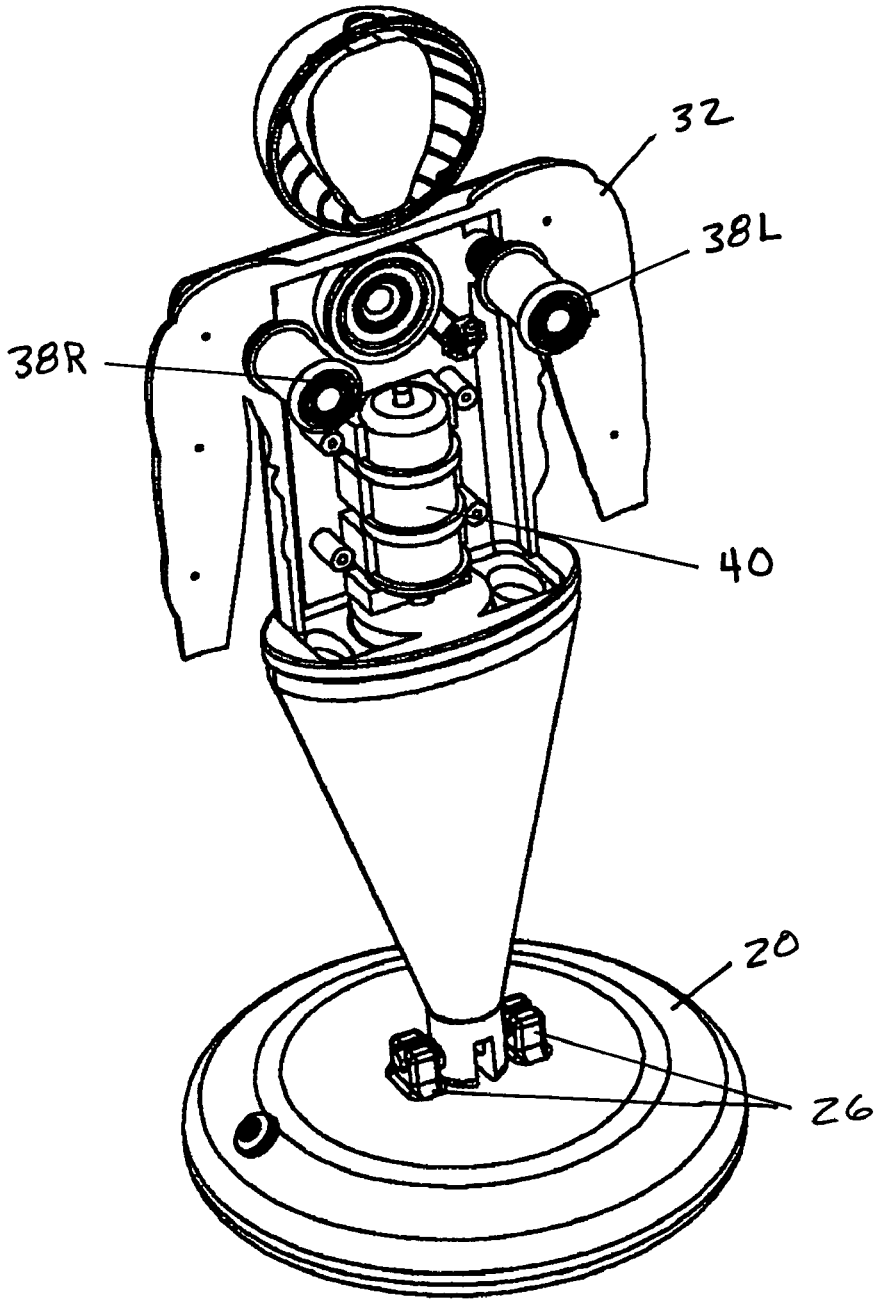
FIG. 3 is a rear perspective view thereof with the rear portion of the upper torso shown in section.
Figure 4:
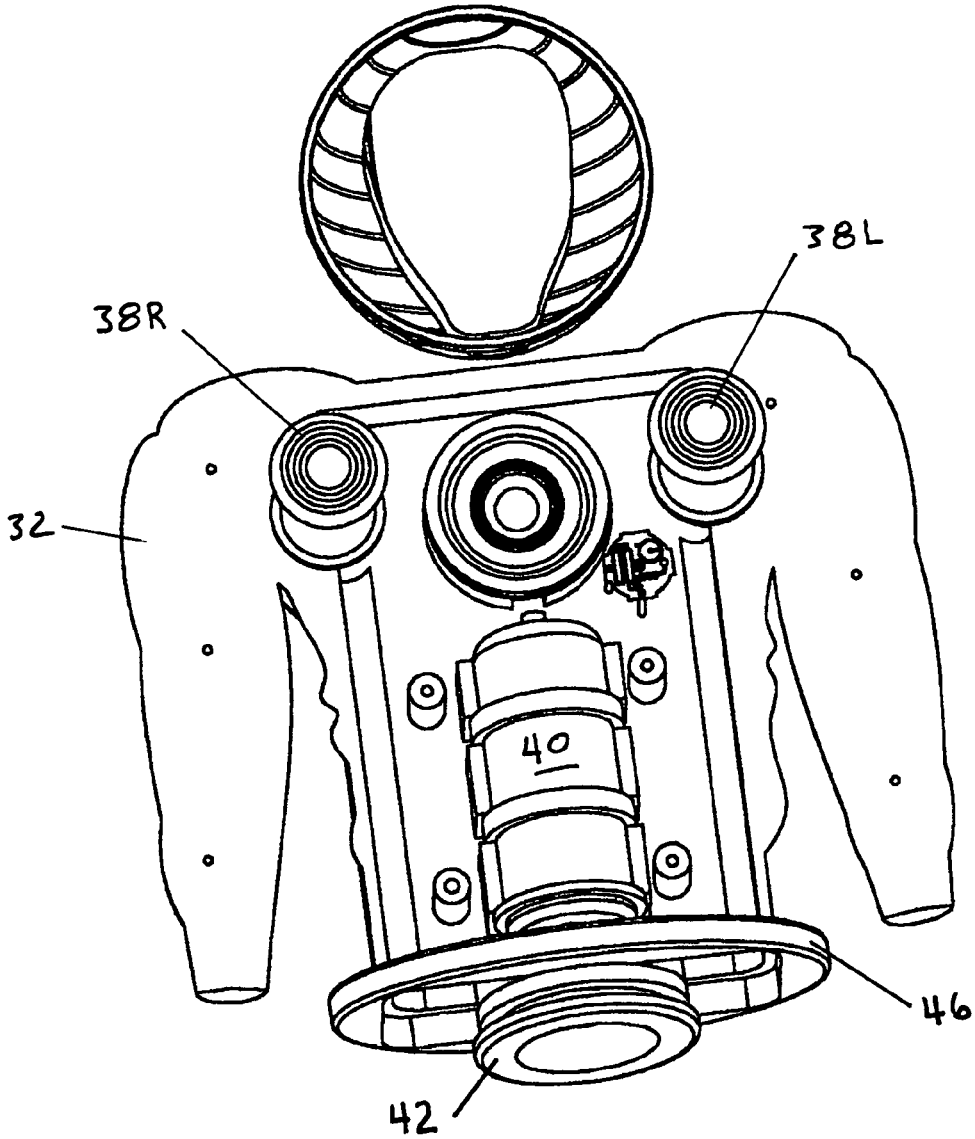
FIGS. 4 and 5 are rear perspective sectional views of the upper torso portion.
Figure 5:
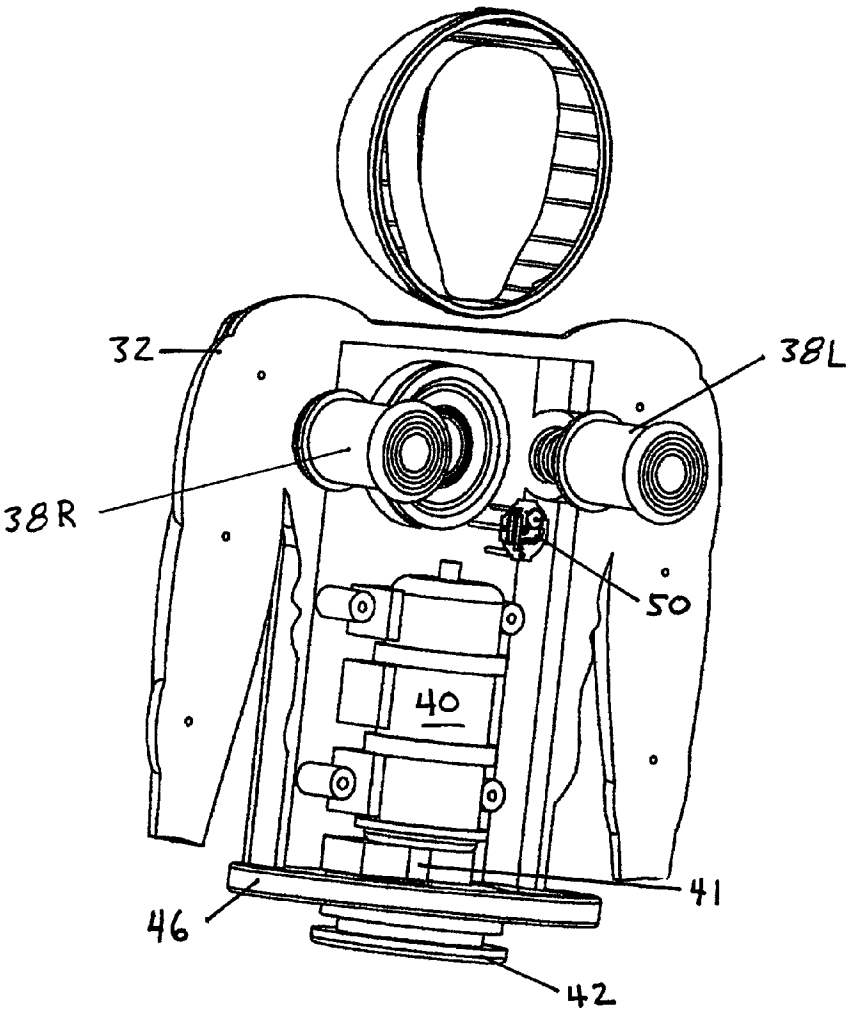
Figure 6:
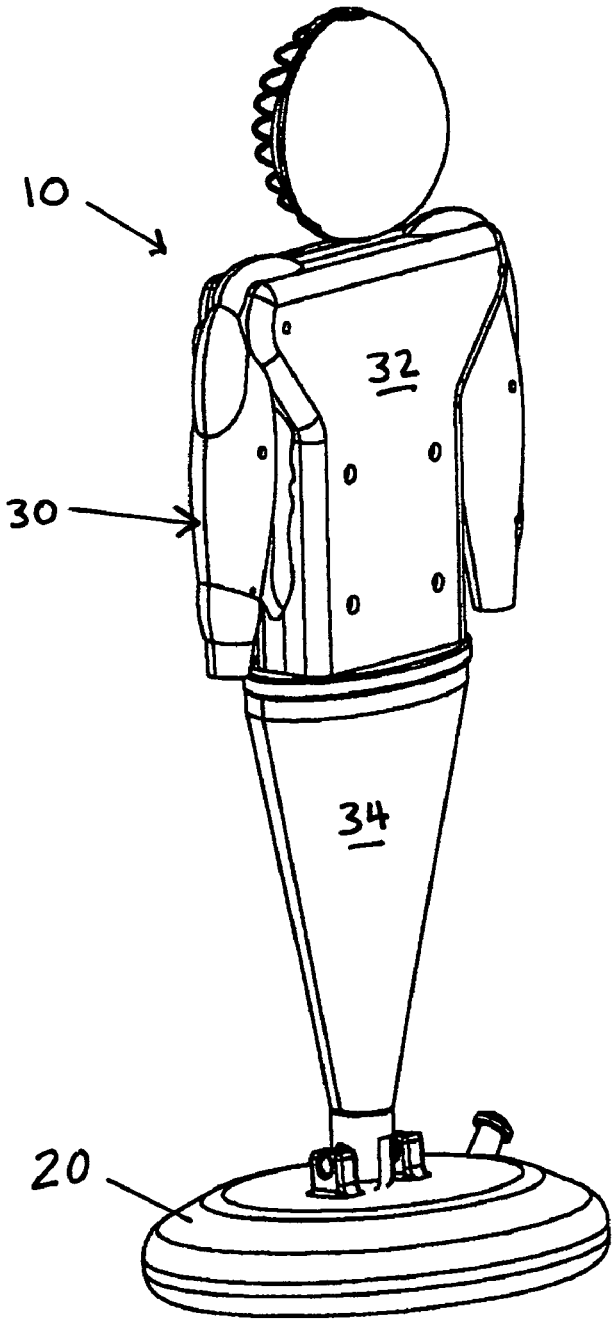
FIG. 6 is a rear perspective view of the football training dummy.
Figure 7:
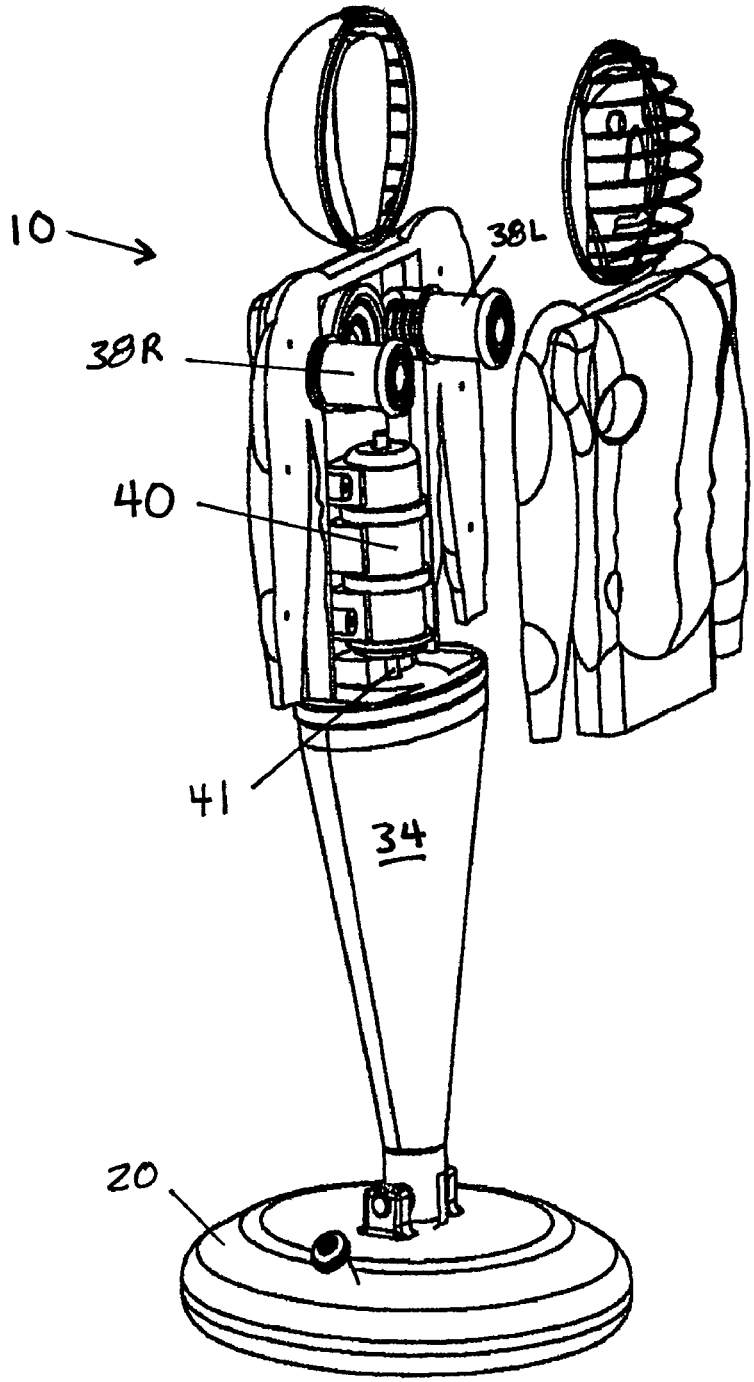
FIG. 7 is a front exploded perspective view thereof.
Figure 8:
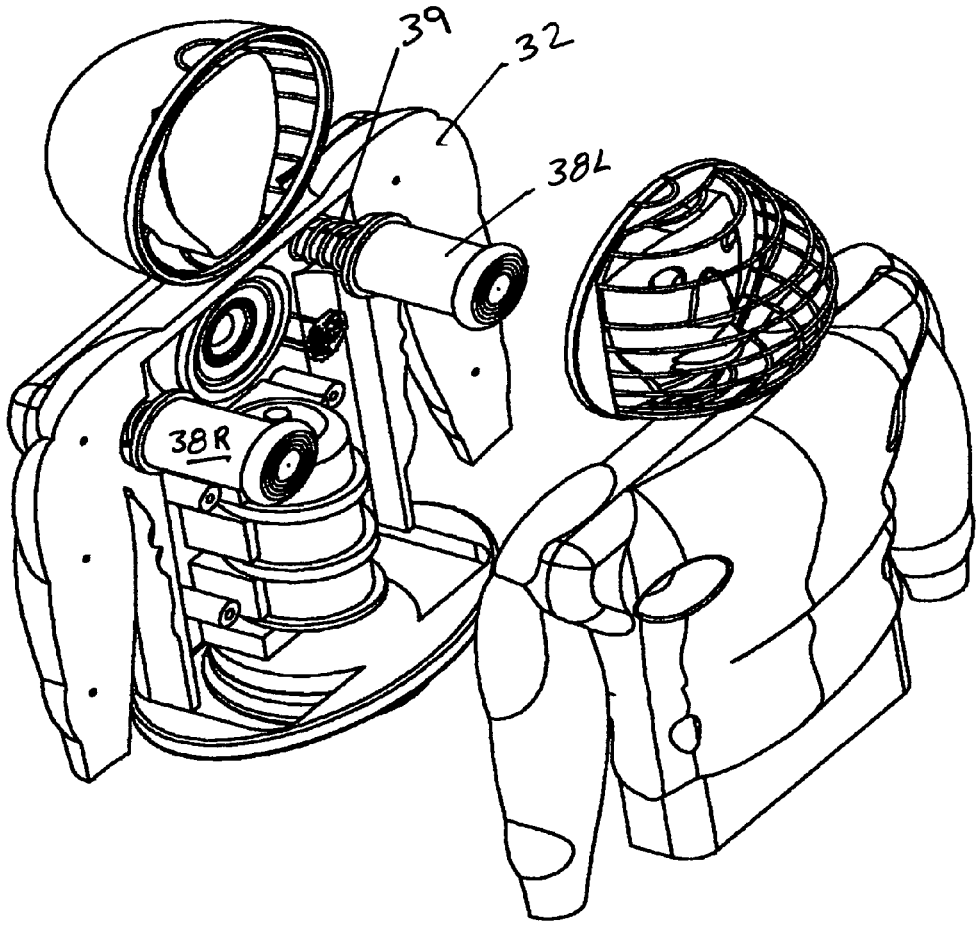
FIG. 8 is a front exploded view of the torso portion thereof.
Figure 9:
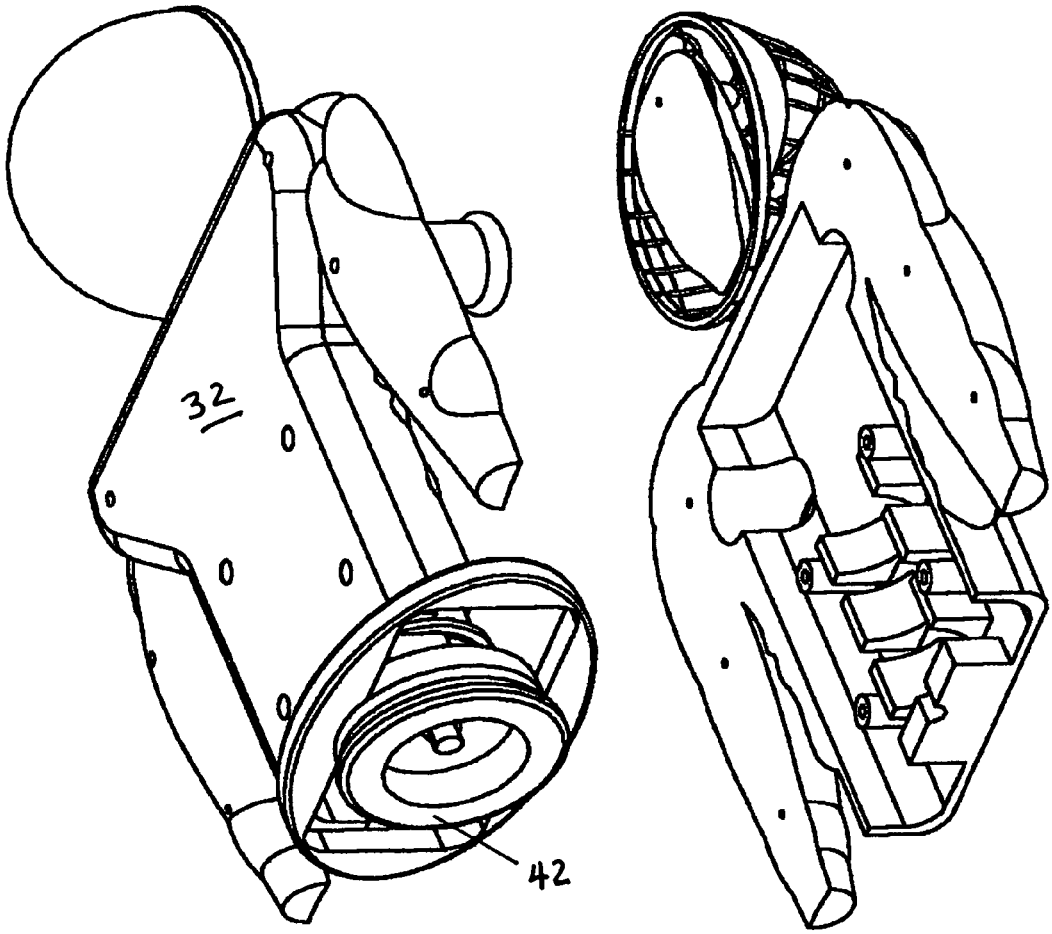
FIG. 9 is a rear exploded view of the torso portion.
Figure 10:
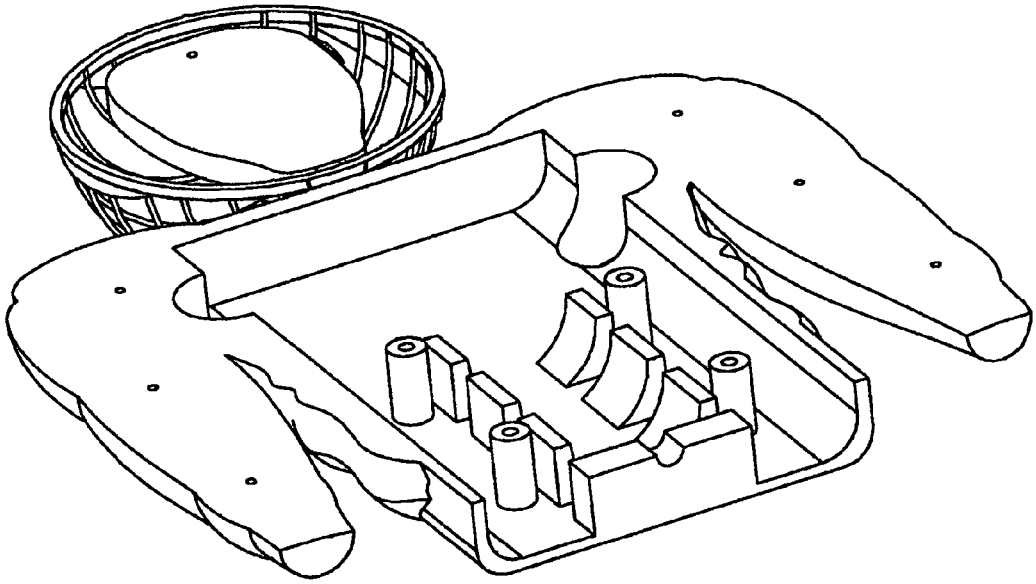
FIGS. 10–12 depict front and rear torso halves.
Figure 11:
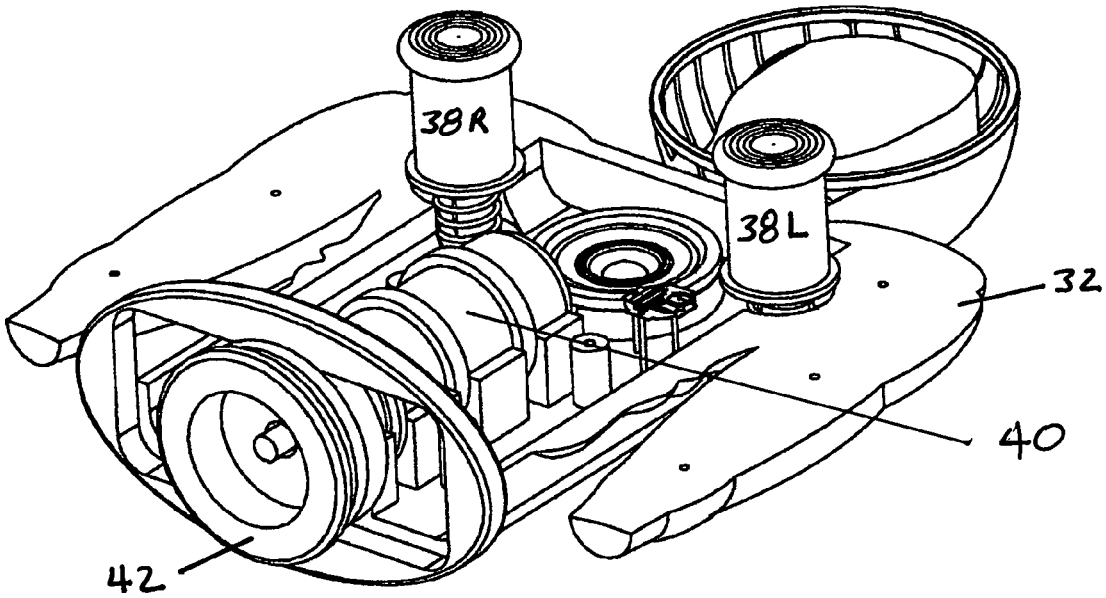
Figure 12:
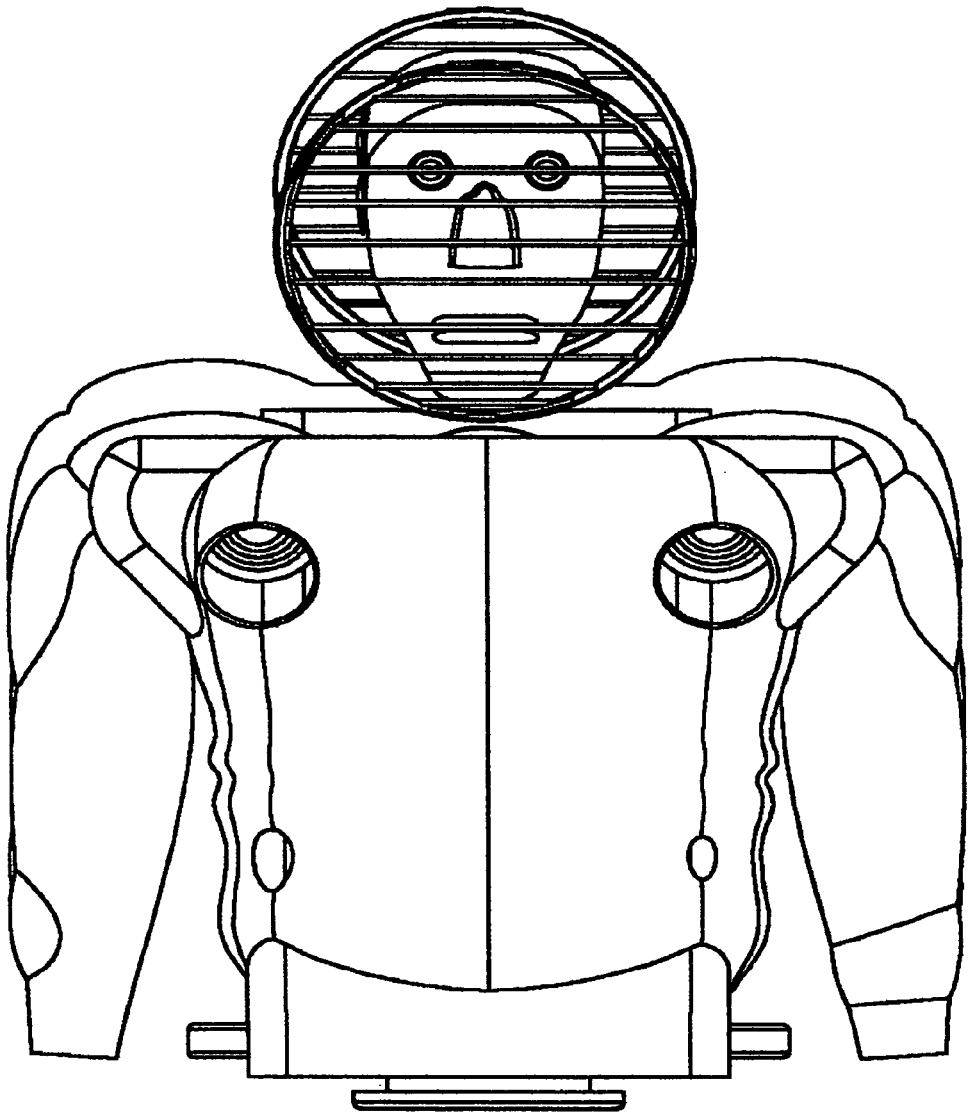
Figure 13:
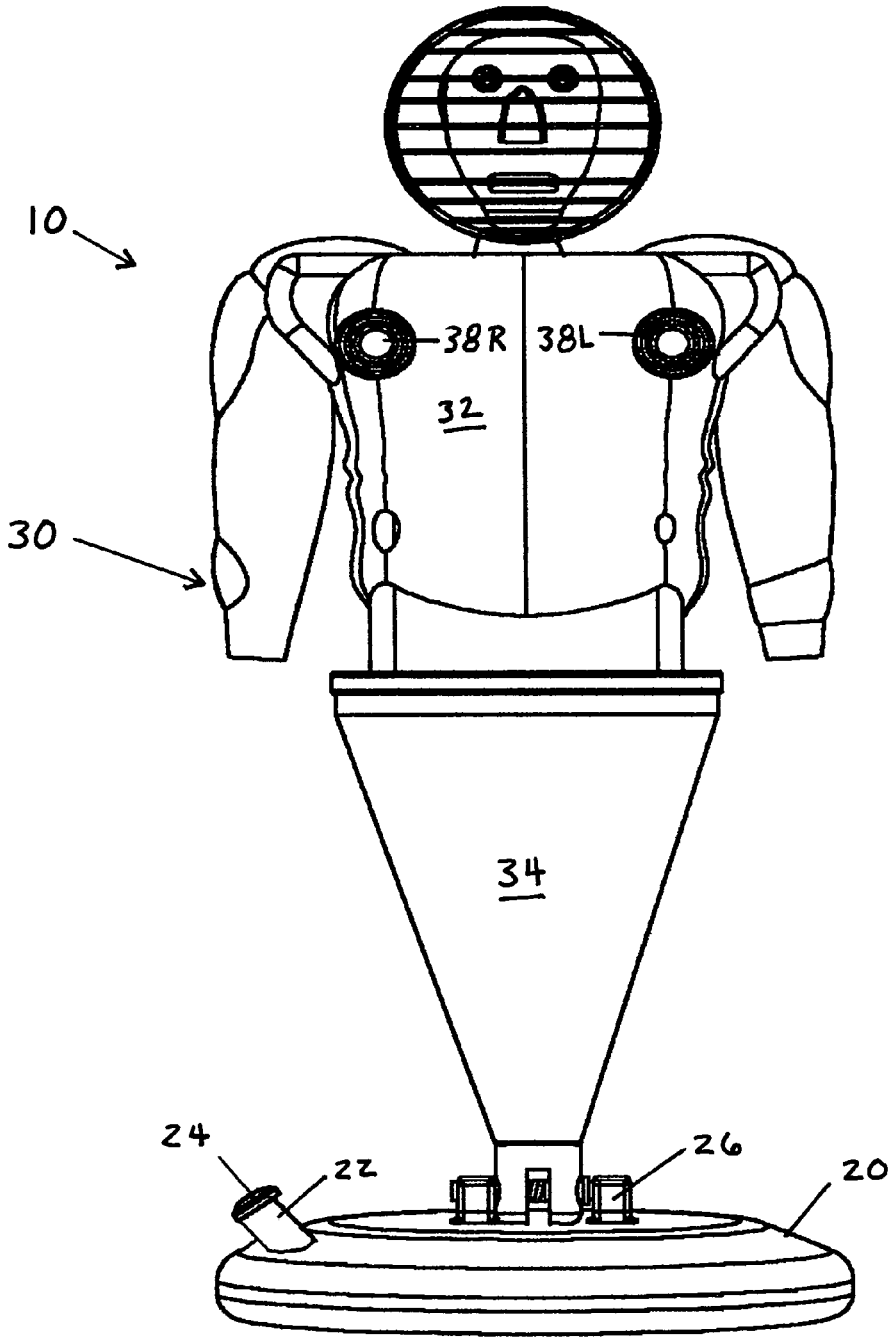
FIG. 13 is a front view of the football training dummy of the present invention.
Figure 14:
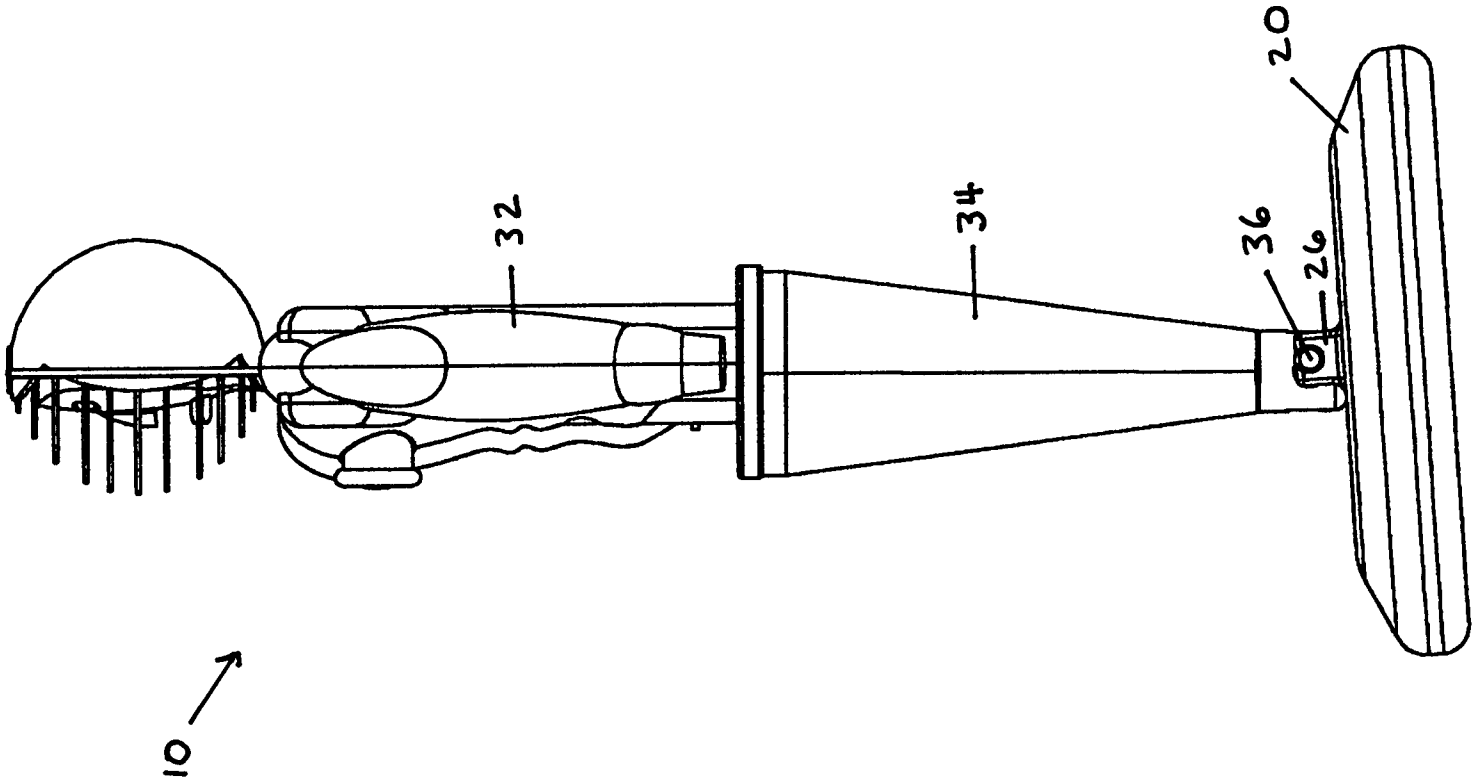
FIG. 14 is a left side view thereof.
Figure 18:
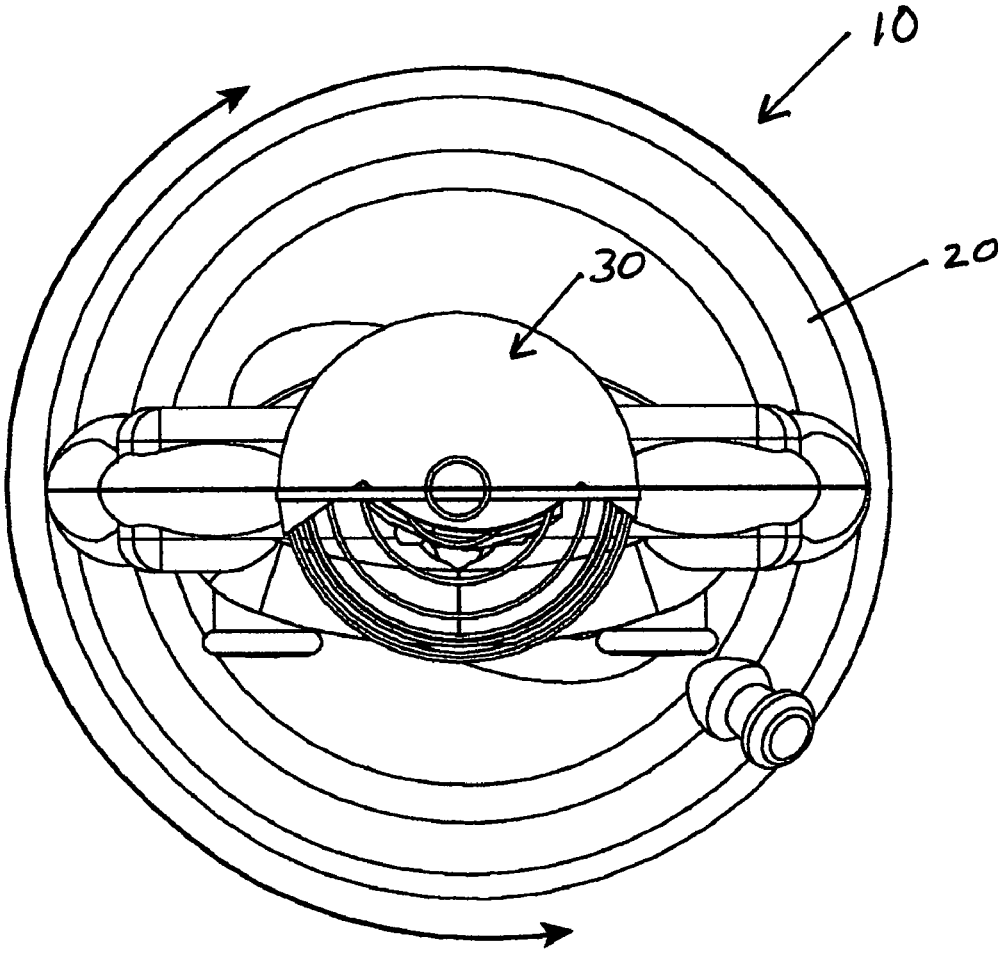
FIG. 18 is a top view thereof illustrating directions of torso rotation.
Figure 19:
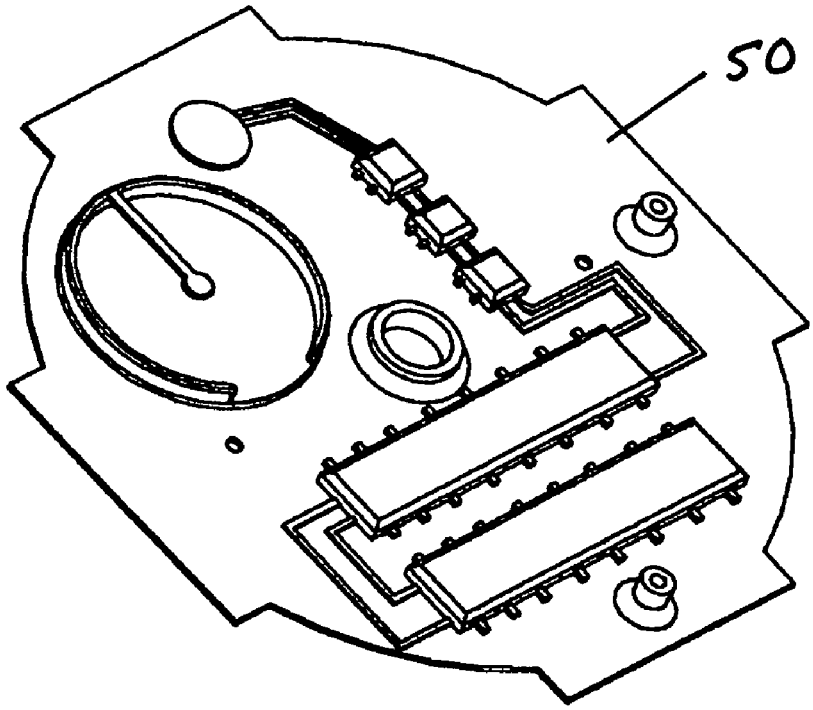
FIG. 19 depicts an electronic circuit board for use in controlling torso rotation.
Figure 20:
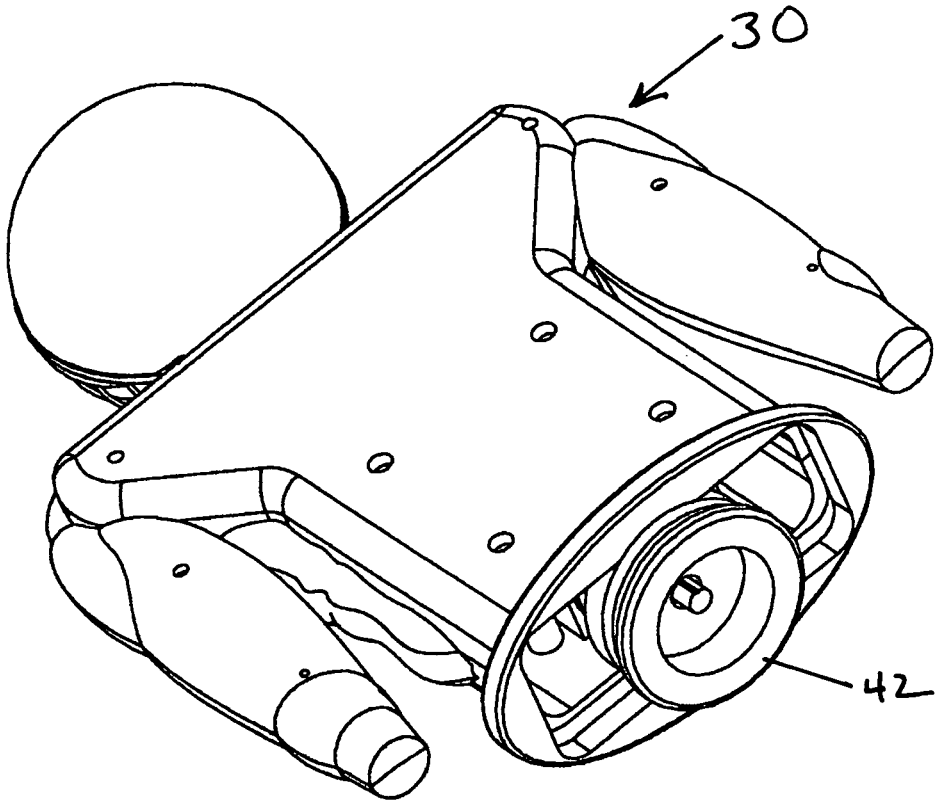
FIG. 20 is a bottom perspective view of the torso portion.

Blocking dummy body 30 preferably includes an upper body or torso portion 32 rotatably connected to a lower body portion 34. Torso portion 32 includes left and right pressure sensing buttons or pads, referenced as 38L and 38R respectively. Pressure sensing buttons 38L and 38R are positioned proximal the upper lateral portion of the torso in a position wherein a blocker's hands are expected to contact during one or more properly executed blocking techniques. Torso 32 further houses an electric motor 40 having an output shaft 41 terminating in a round drive wheel 42 connected to lower body portion 34. Torso 32 may further include guide ring 46 that engages the upper inner edge of lower body portion 34 and functions as a track to guide torso 32 during rotation. Electric motor 40 is controlled by actuation of pressure sensing buttons 38L and 38R. As best depicted in FIG. 8, left and right pressure sensing buttons 38L and 38R each may include a spring, referenced as 39, to bias the buttons forward while providing a system for determining the level of force applied to each button by measurement of spring compression. More particularly, the application of a force to one of the pressure sensing buttons 38, such as that applied by the hand of a blocker during a drill, activates motor 40 to selectively cause rotation of torso 32 in a direction opposite the applied force as illustrated by FIG. 18. Accordingly, when a player applies a force to button 38L, motor 40 is activated cause torso 32 to rotate in a clockwise direction, as seen from the top view illustrated in FIG. 18. The rotational torque supplied by motor 40 continues until a predetermined angle is reached at which point the motor deactivates. An onboard microprocessor 50 is adapted to detect when the predetermined angle of rotation has been reached. As should be further apparent, the spring loaded pivotal connection between the lower body portion 34 and base 20 biases the blocking dummy to a forwardly leaning position and provides resistance to rearward pivotal movement. As a result, a football blocking dummy according to the present invention provides resistance to a force applied thereto, thus simulating the forces and reactions experienced when one football player applies force to an opposing player.

The instant invention has been shown and described herein in what is considered to be the most practical and preferred embodiment. It is recognized, however, that departures may be made therefrom within the scope of the invention and that obvious modifications will occur to a person skilled in the art.

The invention claimed is:

1. A football blocking dummy comprising:

a base;

a lower body portion connected to said base;

an upper body portion rotatably connected to said lower body portion; and means for causing rotation of said upper body portion in response to a force applied to said upper body portion;

said means for causing rotation of said upper body portion in response to a force applied to said upper body portion, includes left and right pads electrically connected to a motor contained within said upper body portion, said motor having an output shaft connected to said lower body portion, whereby the application of a force to said left pad causes clockwise rotation of said upper body portion and the application of a force to said right pad causes counter-clockwise rotation of said upper body portion.

2. A football blocking dummy according to claim 1, wherein said lower body is connected to said base by a pivotal connection, said pivotal connection including means for biasing said body portion forward.

3. A football blocking dummy comprising:

a base;

a lower body portion connected to said base;

an upper body portion rotatably connected to said lower body portion;

said upper body portion including a front having left and right pad actuators, each of said pad actuators electrically connected to a motor contained within said upper body portion;

said motor having an output shaft connected to said lower body portion, whereby the application of a force to said left pad causes rotation of said upper body portion in a clockwise direction opposing the applied force, and the application of a force to said right pad causes rotation of said upper body portion in a counter-clockwise direction opposing the applied force.

4. A football blocking dummy according to claim 3, wherein said base defines an interior volume and openable means for accessing said interior volume.

5. A football blocking dummy according to claim 3, wherein said lower body is connected to said base by a pivot connection.

6. A football blocking dummy according to claim 5, wherein said pivot connection includes a spring.

* * * * *